US005979081A

United States Patent [19]

Vaz

[11] Patent Number: 5,979,081

[45] Date of Patent: Nov. 9, 1999

[54] BLAST AND FRAGMENT RESISTANT SAFETY BOOT FOOTWEAR

[76] Inventor: Guy Andrew Vaz, 20 Pasir Ris Heights, Singapore, Singapore, 519227

[21] Appl. No.: 09/000,308

[22] PCT Filed: Jul. 16, 1996

[86] PCT No.: PCT/SG96/00008

§ 371 Date: Jan. 29, 1998

§ 102(e) Date: Jan. 29, 1998

[87] PCT Pub. No.: WO97/04675

PCT Pub. Date: Feb. 13, 1997

[30] Foreign Application Priority Data

Aug. 1, 1995 [SG] Singapore ..... 9501007-0

[51] Int. Cl.[6] ..... A43B 23/00; A43B 13/12

[52] U.S. Cl. ..... 36/107; 36/25 R; 36/30 R; 36/72 R; 36/77 R

[58] Field of Search ..... 36/107, 108, 25 R, 36/30 R, 72 R, 73, 75 R, 76 R, 77 R

[56] References Cited

U.S. PATENT DOCUMENTS

| | | | |
|---|---|---|---|
| 1,685,538 | 9/1928 | Glidden et al. | 36/75 R |
| 1,701,611 | 2/1929 | Glidden et al. | 36/75 R |
| 3,461,575 | 8/1969 | Tead et al. | 36/30 R |
| 5,003,709 | 4/1991 | Okayasu et al. | 36/107 |
| 5,272,822 | 12/1993 | Diaz | 36/72 R |
| 5,390,430 | 2/1995 | Fitchmun et al. | 36/30 R |
| 5,804,757 | 9/1998 | Wynne . | |
| 5,832,634 | 11/1998 | Wong | 36/30 R |
| 5,843,851 | 12/1998 | Cochran | 36/84 |

*Primary Examiner*—M. D. Patterson

*Attorney, Agent, or Firm*—J.P. Blasko Professional Corp; John P. Blasko

[57] ABSTRACT

A boot having an improved blast and fragment resistant vulcanized rubber boot sole (13) for protection against large anti-personnel mines is described. The sole comprises embedded protective material composed of at least one layer (18) of woven polyaramid (Kevlar) material. The boot further has an upper insole (19) having a critical supporting structure comprised of at least one polyaramid layer (18). An additional graphite or engineering polymer (e.g. Delrin 100) toe-cap (41) and shank are also described.

20 Claims, 2 Drawing Sheets

BLAST AND FRAGMENT RESISTANT SAFETY BOOT FOOTWEAR

FIELD OF THE INVENTION

The present invention relates to the construction of a boot sole, and its critical supporting structure, and more particularly pertains to a new and improved safety boot sole construction to prevent puncturing of the sole by high energy and high velocity projectiles from an anti-personnel mine containing up to 60 grams of compressed compound-B high explosive thus affording greater protection to an individual's foot without over-restricting movement.

DESCRIPTION OF THE PRIOR ART

U.S. Pat. No. 5,237,758 to Zachman: this uses semi-elliptical sections intersecting at loops with adjacent webs of adjacent loops intersecting with flexible rods directed through the intersecting loops to minimize lateral displacement of adjacent webs.

U.S. Pat. No. 5,285,583 to Aleven: this uses a protective layer composed of plastic and including a flexible forepart portion having an insole board bonded to its bottom surface and a fabric liner bonded to its top surface during the process of moulding the protective plastic layer. The plastic used by Aleven is molten plastic injected in the final bonding process.

German Patent DE 4214802, by ZEPF H, to SPORTARTIKELFABRIK UHL GMBH KARL: A multi-layer boot sole having a walking surface, a damping intermediate sole, and an upper insole. The base is a thermoplastic moulding, or is made of metal, ceramic or graphite, in which multi-filament organic or inorganic reinforcing fibers are embedded in the form of a mat, or woven or knitted into the structure. The elastic profiled portions are formed on the underside of the base by injection moulding or pressing. The base can contain only a single layer of woven fibers, its total thickness being approximately 0.5 mm.

Aleven achieved strength and impact resistance from a plastic plate in the sole and the use of a fabric mesh was to reinforce the plastic and not to provide impact resistance. ZEPF H, could only achieve a single layer of not more than 0.5 mm thickness of woven fibers through injection moulding or pressing. Aleven makes no disclosure of the use of metal, ceramic or graphite materials.

So far, techniques to use aramid, ceramic, or graphite fibers in the construction of a boot sole in thicknesses sufficient to prevent puncturing of the sole by high energy and high velocity projectiles have not been mentioned or made feasible due to problems in rigidity and bonding.

An earlier application by the present inventor (SG 9500037-8) for safety footwear was designed for the much smaller "scattered mines" of Soviet design. However this design would afford less protection when a large anti-personnel mine was detonated under the toes or by the side of the boot.

SUMMARY OF THE INVENTION

The boot soles described in the prior art are insufficient protection against the larger anti-personnel mines containing up to 60 grams of high explosive when it is desired to conserve toe-to-heel flexion. This is especially the case if a large anti-personnel mine is detonated in the toe area or by the side of the boot.

In a first aspect, the present invention consists in a boot having an anti-personnel mine resistant rubber boot sole comprising embedded protective material which is embedded throughout the entire sole and is composed of at least 10 woven polyaramid (Kevlar) layers, the density of each layer being less than or equal to 4 oz per square yard.

This inventor has found that a plurality of thin layers of polyaramid affords better protection than one or a small number of thicker layers of a material having the same overall thickness and density. Increasing density and additional layers of woven polyaramid fibers also increases the blast and fragment resistance.

In a preferred embodiment, the present invention also includes a supporting structure comprising sandwiched protective polyaramid (Kevlar) material embedded throughout the boot-upper. The boot-upper is preferably made of leather. The protective material is composed of at least 1 woven polyaramid (Kevlar) layer, the density of each layer being less than or equal to 4 oz per square yard. Increasing the density and adding additional layers of woven polyaramid fibers in the boot-upper would increase the protection offered by the supporting structure.

A woven layer of mineral fibers, notably ceramic fibers or S-glass fibers, can be included into the boot just below the insole to act as a fire wall for protection against hot gases with temperatures of between 815 to 1,650 degrees Celsius.

In a further embodiment, at least one layer of woven carbon graphite fibers can be sandwiched between or adjacent the polyaramid (Kevlar) layers to further strengthen and stiffen the sole before stitching.

It is also a desired feature of the present invention to provide a boot sole which exhibits good adhesion between the rubber portion of the sole and the polyaramid (Kevlar) layers and/or graphite fiber bundles, despite the poor intrinsic adhesion between the polyaramid fibers, graphite fibers, and the rubber. It is also desired that the supporting structure exhibits good adhesion between the leather boot-upper and the polyaramid layer(s) embedded throughout the upper despite poor intrinsic adhesion between the polyaramid fibers and the leather. In manufacturing the sole, solvent based rubber adhesive can be applied onto pretreated polyaramid (Kevlar) and/or graphite fiber bundles before vulcanisation of the rubber. The boot upper with the embedded supporting Kevlar and protective mid-sole are then sewn together along the edge around the entire sole before vulcanising.

A composite or advanced polymer shank can also be used in the boot rather than the normal steel shank. The composite shank can be made of carbon graphite fibers and/or polyaramid (Kevlar) roving saturated in epoxy and placed in a mould, or moulded engineering polymer (e.g. Zytel or Delrin).

A composite or advanced polymer toe-cap can also be used in the boot rather than the normal steel cap. The toe-cap can be made of epoxied carbon graphite fibers and/or epoxied polyaramid (Kevlar) roving, or engineering polymer (e.g. Delrin 100).

BRIEF DESCRIPTION OF THE DRAWINGS

The invention will be better understood and features other than those set forth above will become apparent when consideration is given to the following detailed description thereof. Such description makes reference to the annexed drawings wherein.

DESCRIPTION OF THE PREFERRED EMBODIMENTS

Figure 1:
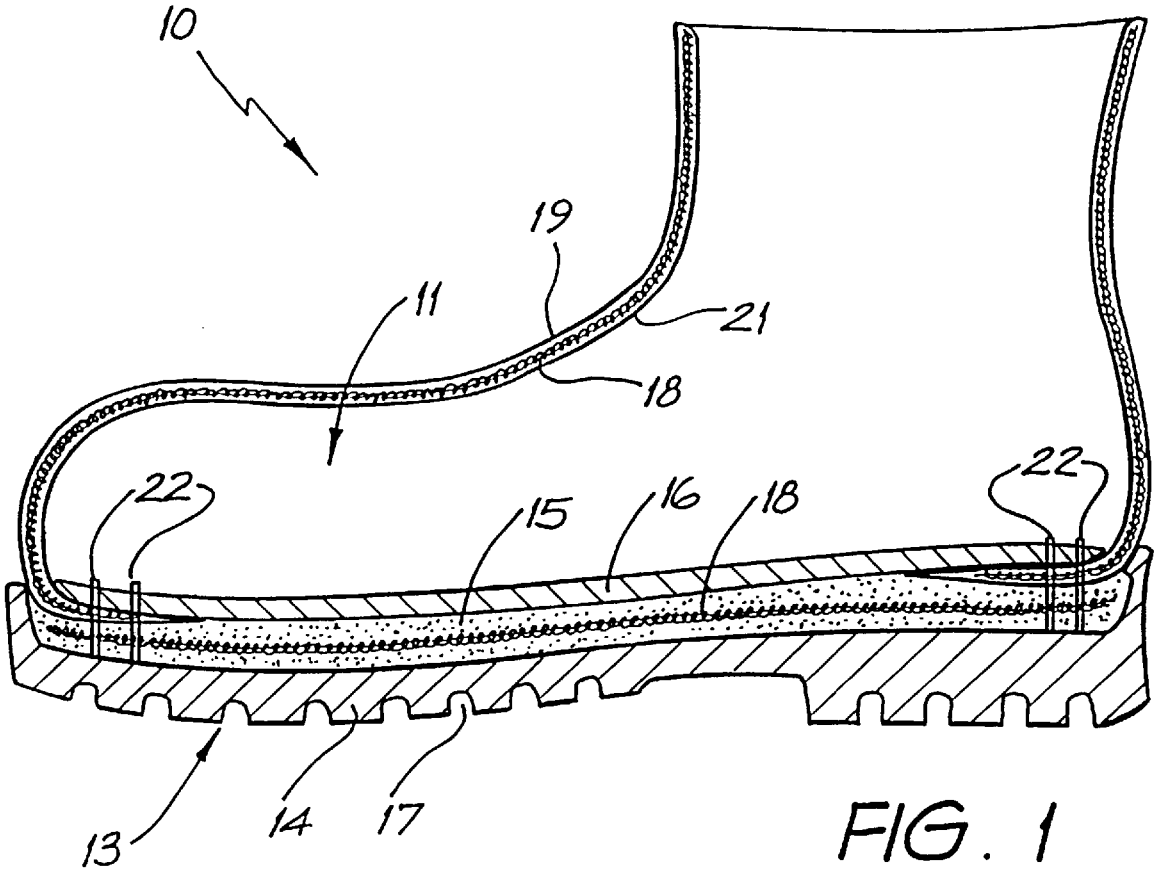
FIG. 1 is a vertical cross-sectional view of a boot according to the present invention.
Figure 2:
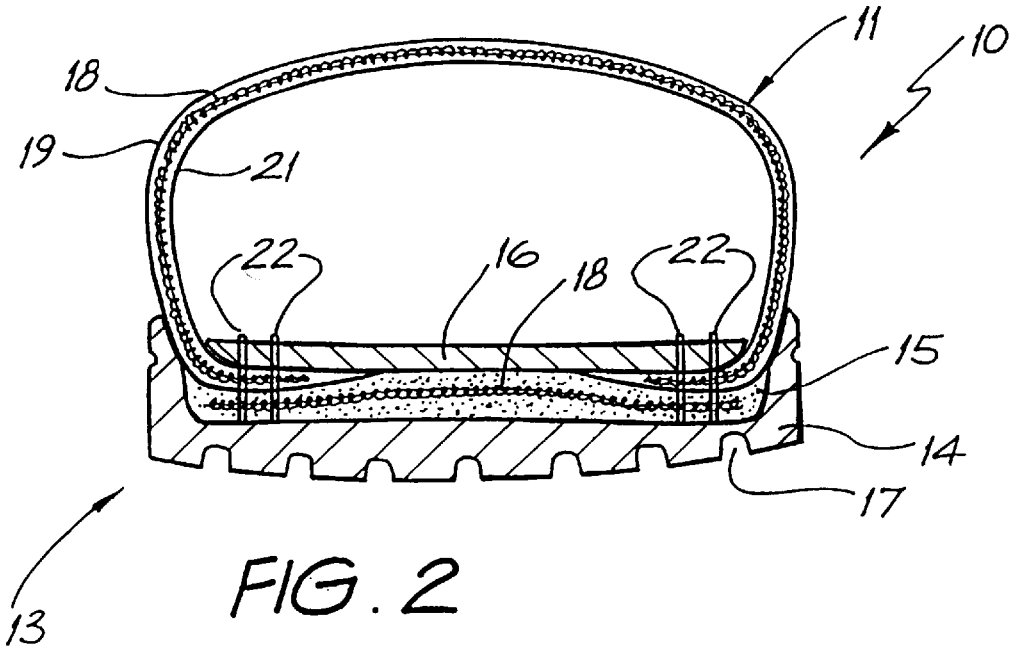
FIG. 2 is a cross-sectional view of the mid-boot region of the boot depicted in FIG. 1.

A boot having the features of a first embodiment of the present invention is generally depicted as 10 in FIGS. 1 and 2.

The boot 10 has a standard shaped upper portion 11 and a composite sole 13. The composite sole comprises an outer rubber sole 14 having a tread 17, an intermediate sole 15 into which is embedded layers of polyaramid fibers 18, and an upper sole 16. The upper portion 11 is leather and also incorporates a supporting structure comprising layers of polyaramid fibers 18. The safety boot sole is made in a traditional single-stage vulcanising mould which is commonly used in the vulcanised rubber shoe soling industry.

The leather upper 11 containing the supporting structure comprises sandwiched supportive material consisting of 4 layers of polyaramid (Kevlar) 18, the density of each layer being less than or equal to 4 oz per square yard. The supportive material is sandwiched between the leather-upper 19 and the inner vamp leather layer 21 throughout the entire upper. In the toe and heel sections of the leather upper 11 a crowfoot of lino weave (bi-directional) of the polyaramid fibers is used as it makes it easier to form the polyaramid during lasting.

The protective layer 18 in the intermediate sole 15 comprises at least 10 layers of polyaramid (Kevlar), the density of each layer being less than or equal to 4 oz per square yard. The protective sandwich is then sewn into the upper 11, which includes the supporting structure of Kevlar 18 and upper sole 16 along the whole sole about 5 mm from its edge while in the lasting last. The stitching 22 is depicted in the drawings. The sole 13 is then coated with industry standard latex adhesive and left to dry on racks.

After drying the last is inserted into the boot 10 which is then ready to be inserted into the vulcanising machine. About 350 grams of rubber (for size 277) is placed into a vulcanising sole mould cavity to form the outer (lower) sole 14.

To allow good adhesion and/or penetration to/by the rubber, the lowest polyaramid (Kevlar) layer 18 can be precoated with industry standard rubber solvent adhesives.

The thickness of each layer of the polyaramid (Kevlar) is typically 0.01 inches, using Kevlar 49 plain weave with tensile strength of 43,000 PSI and modulus 19 million PSI.

A boot 10 with sole 13 made according to the above method with the preferred 30 layers of 4 oz per square yard polyaramid woven Kevlar is effective in providing blast and fragment resistance from a large anti-personnel mine having 50 grams of compressed Compound B high explosive. It was found that large numbers of thinner layers of polyaramid were more effective than a fewer number of thicker layers. It was also found that the supportive structure of the upper 11 is not critical for protection but critical in keeping the protective intermediate sole 15 in place so that the entire boot 10 is effective against large mines. Without the supporting structure in the upper 11, the intermediate sole 15 will lose its integrity and break up, allowing blast penetration of the foot cavity. The protective attributes of the preferred 6 layers of polyaramid embedded in the upper 11 are effective against a 100 grain projectile with velocity of 1000 fps (about a small calibre pistol). Increasing the layers will improve on the bullet proofing qualities. It also conserves good toe-to-heel flexion in order to enable running, jumping and to clear obstacles such as rope ladders, rope climbing, small steps, while avoiding delamination of the sole 13 in subsequent use.

Figure 3:
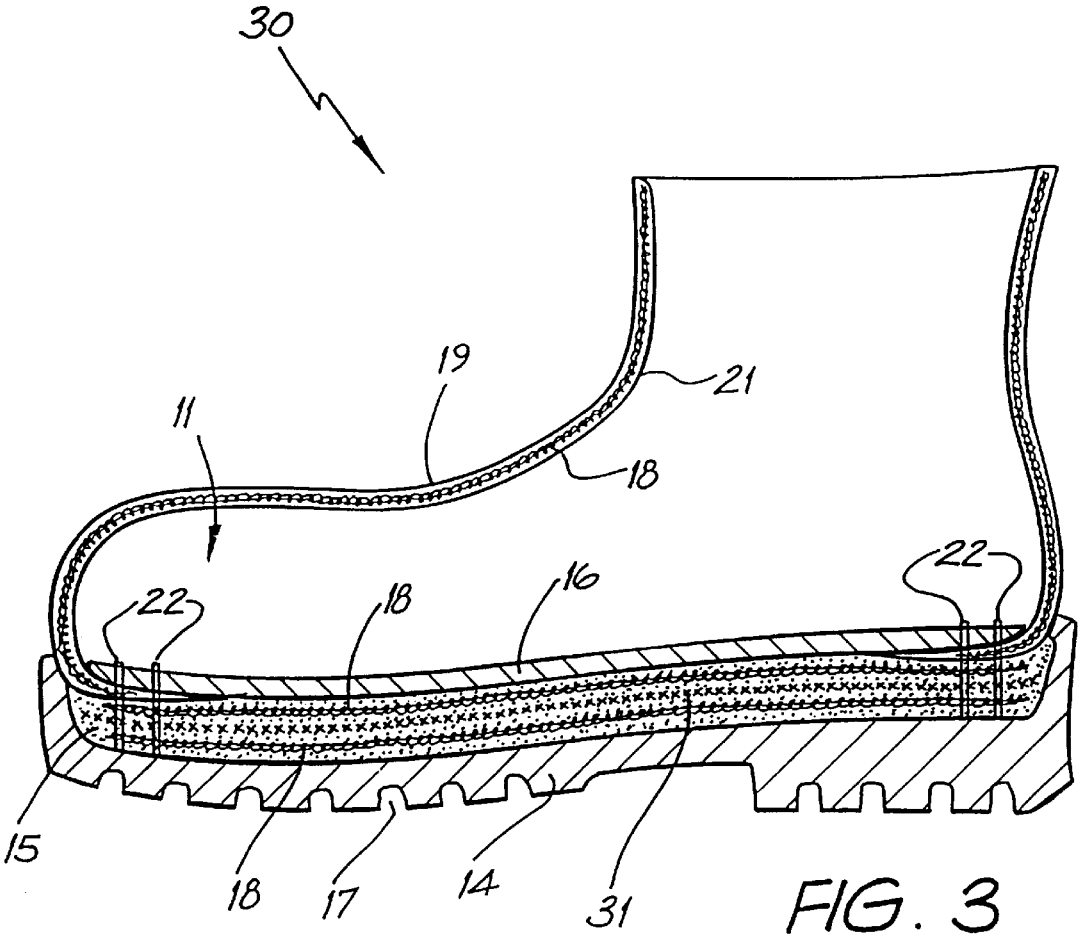
FIG. 3 is a vertical cross-sectional view of a second embodiment of the boot according to the present, invention.

A boot having the features of a second embodiment of the invention is generally depicted as 30 in FIG. 3. In this embodiment, the outer and intermediate sole 14 and 15 and leather upper 11 are made in the same manner as the embodiment depicted in FIGS. 1 and 2. In addition, 1 to 4 layers of woven graphite 31 are inserted into the intermediate sole 15 before sewing. Each layer of graphite 31 has a density less than or equal to 8 oz per square yard and a thickness of 0.013 inches with tensile strength of 550,000 PSI and modulus 36 million PSI.

Figure 4:
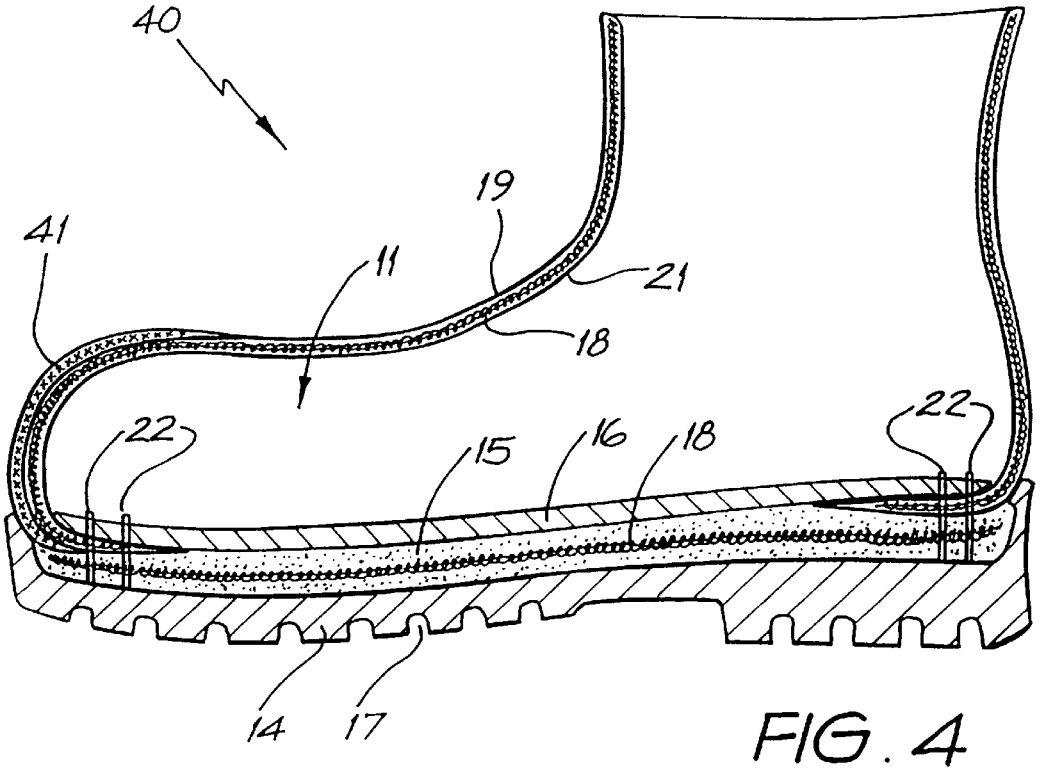
FIG. 4 is a vertical cross-sectional view of a third embodiment of a boot according to the present invention.

In a third embodiment of this invention, depicted as 40 in FIG. 4, the outer and intermediate soles 14 and 15 and leather upper 11 are made in the same manner as the embodiments described above. In addition, a composite or engineering polymer toe cap 41 is inserted prior to the lasting of the leather upper 11. The composite toe-cap 41 is constructed of epoxied graphite and Kevlar or engineering polymer (e.g. Delrin 100). The traditional steel toe-cap has a higher likelihood of causing injury to the wearer than the composite or advanced polymer constituting the toe cap 41 which is also stronger yet more resilient.

In a fourth embodiment of the invention, which is not depicted, ceramic fiber layers can be inserted into the intermediate sole 15 before sewing of the sole 13 into the upper 11 as in the embodiments of the boot described above.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

I claim:

1. An improved blast and fragment resistant boot, said boot comprising a sole comprising embedded protective material characterized in that the material is embedded through the entire sole and is composed of at least 10 woven polyaramid layers where the density of each layer is less than or equal to 4 oz per square yard and an upper supporting structure comprising embedded protective material characterized in that the material is embedded throughout the upper and is composed of at least 2 woven polyaramid layers.

2. The boot according to claim 1, characterized in that the embedded material comprises multiple thin layers of woven polyaramid, the thickness of which are less than or equal to 0.01 inches.

3. The boot according to claim 1 characterized in that the embedded material in the sole of at least 10 polyaramid woven layers, the thickness of each layer being less than 0.01 inches, is sewn together to the upper along the entire edge of the sole.

4. The boot according to claim 1 characterized in that a composite or advanced polymer toe-cap is inserted prior to the lasting of the upper and is constructed of epoxied graphite and polyaramid or engineering polymer.

5. The boot according to claim 1 characterized in that a carbon graphite layer is sandwiched between the polyaramid layers of the sole.

6. The boot according to claim 1, wherein said boot further comprises a shank constructed of carbon graphite or polyaramid rovings with epoxy or of an engineering polymer.

7. The boot according claim 2 characterized in that a composite or advanced polymer toe-cap is inserted prior to the lasting of the upper and is constructed of epoxied graphite and polyaramid or engineering polymer.

8. The boot according claim 3 characterized in that a composite or advanced polymer toe-cap is inserted prior to the lasting of the upper and is constructed of epoxied graphite and polyaramid or engineering polymer.

9. The boot according to claim 2 characterized in that a carbon graphite layer is sandwiched between the polyaramid layers of the sole.

10. The boot according to claim 3 characterized in that a carbon graphite layer is sandwiched between the polyaramid layers of the sole.

11. The boot according to claim 4 characterized in that a carbon graphite layer is sandwiched between the polyaramid layers of the sole.

12. The boot according to claim 7 characterized in that a carbon graphite layer is sandwiched between the polyaramid layers of the sole.

13. The boot according to claim 8 characterized in that a carbon graphite layer is sandwiched between the polyaramid layers of the sole.

14. The boot according to claim 2, wherein said boot further comprises a shank constructed of carbon graphite or polyaramid rovings with epoxy or of an engineering polymer.

15. The boot according to claim 3, wherein said boot further comprises a shank constructed of carbon graphite or polyaramid rovings with epoxy or of an engineering polymer.

16. The boot according to claim 4, wherein said boot further comprises a shank constructed of carbon graphite or polyaramid rovings with epoxy or of an engineering polymer.

17. The boot according to claim 5, wherein said boot further comprises a shank constructed of carbon graphite or polyaramid rovings with epoxy or of an engineering polymer.

18. The boot according to claim 9, wherein said boot further comprises a shank constructed of carbon graphite or polyaramid rovings with epoxy or of an engineering polymer.

19. The boot according to claim 10, wherein said boot further comprises a shank constructed of carbon graphite or polyaramid rovings with epoxy or of an engineering polymer.

20. The boot according to claim 11, wherein said boot further comprises a shank constructed of carbon graphite or polyaramid rovings with epoxy or of an engineering polymer.

* * * * *